United States Patent [19]

Lievestro et al.

[11] Patent Number: 4,796,423

[45] Date of Patent: Jan. 10, 1989

[54] SHEET METAL PANEL

[75] Inventors: Louis Lievestro, West Chester; James S. Kelm, Milford; Arthur L. Ludwig; Harvey M. Maclin, both of Cincinnati; Thomas G. Wakeman, West Chester, all of Ohio

[73] Assignee: General Electric Company, Cincinnati, Ohio

[21] Appl. No.: 4,827

[22] Filed: Jan. 12, 1987

Related U.S. Application Data

[63] Continuation of Ser. No. 786,722, Oct. 15, 1985, abandoned, which is a continuation of Ser. No. 562,566, Dec. 19, 1983, abandoned.

[51] Int. Cl.[4] ..... F02G 1/00; F02G 3/00

[52] U.S. Cl. ..... 60/39.33; 60/39.75; 415/200; 415/219 R; 403/209; 403/354

[58] Field of Search ..... 60/39.31, 39.32, 39.33, 60/757, 39.75; 415/178, 219 R, 115, 116, 200; 29/156.8 R; 403/209, 331, 354

[56] References Cited

U.S. PATENT DOCUMENTS

| | | | |
|---|---|---|---|
| 108,304 | 10/1870 | Valentine | 403/209 |
| 841,755 | 1/1907 | Willson | 403/209 |
| 2,801,520 | 8/1957 | Highberg | 60/757 |
| 2,919,891 | 1/1960 | Oliver | 415/136 |
| 3,238,718 | 3/1966 | Hill | 60/39.37 |
| 3,344,601 | 10/1967 | Mieczkowski, Jr. | 60/39.32 |
| 3,844,343 | 10/1974 | Burggraf | 415/116 X |
| 3,966,354 | 6/1976 | Patterson | 60/39.32 X |
| 3,986,789 | 10/1976 | Pask | 415/189 |
| 4,086,757 | 5/1978 | Karstensen et al. | 60/39.161 |
| 4,111,369 | 9/1978 | Sharpe | 239/406 |
| 4,135,851 | 1/1979 | Bill et al. | 415/200 |
| 4,187,054 | 2/1980 | Landis, Jr. et al. | 415/115 |
| 4,242,042 | 12/1980 | Schwarz | 415/175 |
| 4,414,816 | 11/1983 | Craig et al. | 60/757 |
| 4,475,344 | 10/1984 | Mumford et al. | 60/757 |
| 4,478,551 | 10/1984 | Honeycutt, Jr. et al. | 415/142 |
| 4,480,436 | 11/1984 | Maclin | 60/39.32 |
| 4,555,901 | 12/1985 | Wakeman et al. | 60/757 |

*Primary Examiner*—Donald E. Stout

*Attorney, Agent, or Firm*—Steven J. Rosen; Derek P. Lawrence

[57] ABSTRACT

A sheet metal panel comprising a bent region is disclosed. The region defines a first arc of intersection with a first plane and a second arc of intersection with a second plane. The second arc has a radius of less than twice the thickness of the panel.

28 Claims, 2 Drawing Sheets

SHEET METAL PANEL

This is a continuation of application Ser. No. 786,722, filed 10,15,85 now filed 12, 19, 83 abandoned, which is a continuation of application Ser. No. 562,566, also now abandoned.

This invention relates generally to sheet metal panels in gas turbine engines. More particularly, it relates to arcuate panels with small radii bends, especially where such bends are substantially normal to the direction of arc.

Related to this application is co-pending and concurrently filed case, Ser. No. 562,959, filed Dec. 19, 1983, now U.S. Pat. No. 4,628,694 and assigned to the same assignee as the present application.

BACKGROUND OF THE INVENTION

Gas turbine engines have numerous annular areas, including combustor, high pressure turbine and low pressure turbine. Each of these areas is bounded by a liner or shroud which defines a flowpath. Typical liners/shrouds may be segmented into a number of arcuate panels with a means for attaching each panel to a support.

In the past, such panels have been formed by rough casting of the part followed by precision machining. These panels tend to be heavy due to casting limitations requiring minimum thicknesses. They also may exhibit weaknesses due to voids created during the casting process. Furthermore, the machining operation requires additional time resulting in more expensive panels.

Panels may also be formed by alternative fabrication techniques. For example, in low pressure turbine shrouds, sheet metal members may be joined together to form the panel. Again, as with machining, such techniques are time consuming and expensive.

OBJECTS OF THE INVENTION

It is an object of the present invention to provide a new and improved arcuate sheet metal panel for use in a gas turbine engine.

It is another object of the present invention to provide a less expensive flowpath liner than those heretofore known.

It is a further object of the present invention to provide a new and improved arcuate sheet metal shroud for use in a high pressure turbine.

SUMMARY OF THE INVENTION

In accordance with the present invention, a sheet metal panel in a gas turbine engine comprises at least one arcuate section circumferentially disposed about the engine centerline having at least one circumferentially extending bend defining a bent region. The region defines a first arc of intersection with a first plane. The region further defines a second arc of intersection with a second plane. The second arc has an inner radius corresponding to the respective bend radius less than twice the thickness of the panel.

In a specific embodiment of the present invention, a sheet metal shroud panel comprises a generally arcuate shroud backing, a first web and a first rail. The first web extends outwardly from the backing and the first rail extends from the first web. The first rail includes first and second sections wherein the second section is folded back on the first section thereby forming a bent region having an approximately one-hundred-eighty degree bend hereinafter denoted as 180° bend. This bent region defines a first arc of intersection with a first plane and defines a second arc of intersection with a second plane. The second arc has an inner radius corresponding to the respective bend radius less than the thickness of the panel.

DETAILED DESCRIPTION OF THE INVENTION

Figure 1:
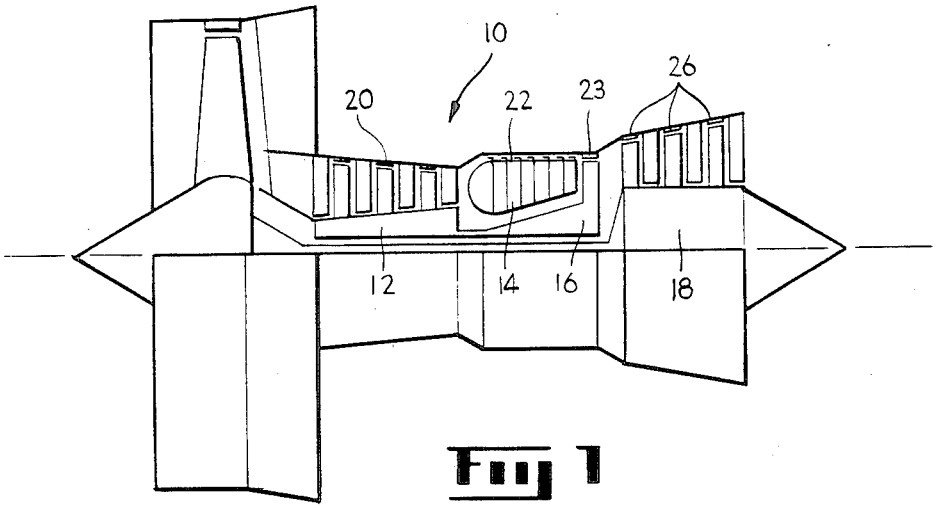
FIG. 1 is a schematic view of a gas turbine engine.

FIG. 1 shows a gas turbine engine 10 with compressor 12, combustor 14, high pressure turbine 16, and low pressure turbine 18. Each of these annular areas is radially bounded by a structure which defines a flowpath. Compressor 12 is bounded by casing 20, combustor 14 by liner 22, and turbines 16 and 18 by shrouds 23 and 26. Each of these structures must be connected to a support. In addition, each structure may be segmented into a number of arcuate panels for varying engineering and assembling reasons. Although the requirements for strength, heat resistance, weight, etc. for each of these structures may differ, they all have a common need for strong, reliable, and relatively inexpensive means for attaching to a support.

Figure 2:
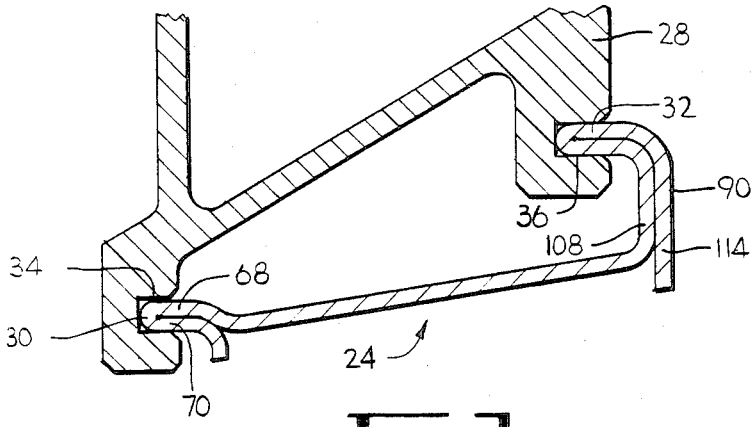
FIG. 2 is a cross-sectional view of a shroud panel and mounting according to one form of the present invention.
Figure 3:
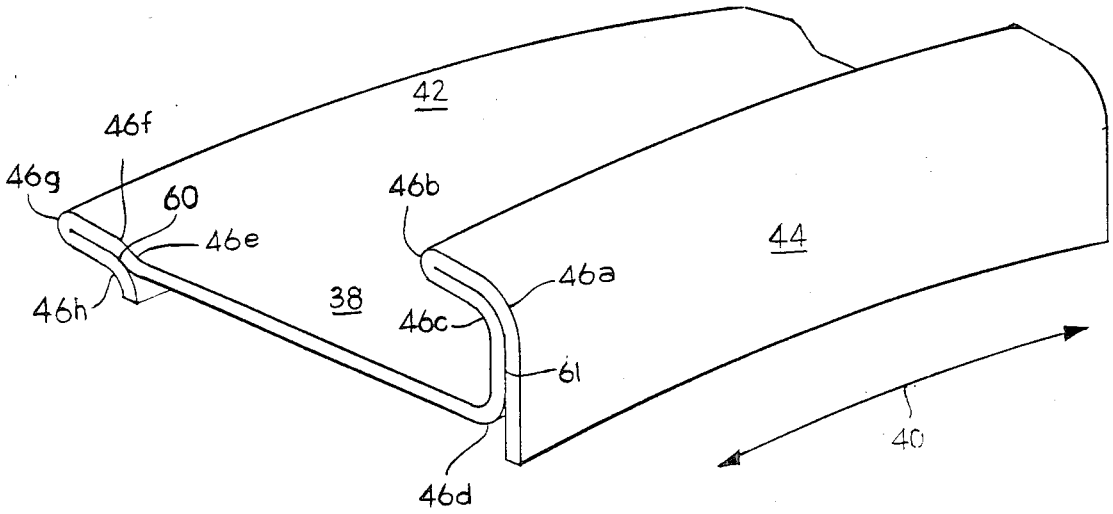
FIG. 3 is a perspective view of the shroud panel in FIG. 2.
Figure 4:
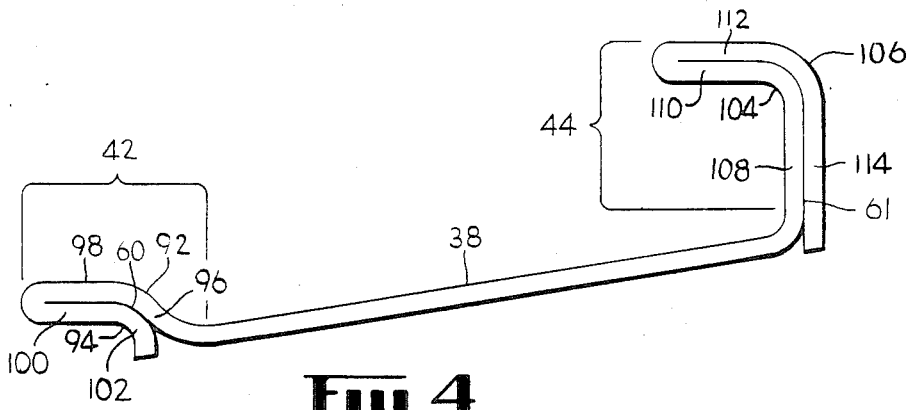
FIG. 4 is a cross-sectional view of the shroud panel in FIG. 2.

One embodiment of the present invention is shroud panel 24 which is an arcuate segment of high pressure turbine shroud 23. Shroud panel 24, a view of which is shown in FIGS. 2, 3, and 4, is formed from a single piece of sheet metal. Numerous materials may be advantageously employed for the sheet metal. Typically, high temperature alloys suited for use in the turbine section of gas turbine engines are based on nickel or cobalt. For example, commercially available materials with these features are Hastalloy X, HS188, L605, Rene' 41, Waspalloy, MA754, and MA956. The thickness T of the sheet metal will be determined by the application. In one embodiment, thickness T will be greater than 25 mils and in a preferred embodiment will be between 25 mils and 60 mils.

Panel 24 includes a generally arcuate shroud backing 38. The arcuate shape generally conforms to the circumferential direction 40 of the turbine as bounded by shroud panels 24. Panel 24 also includes forward attachment structure 42 and aft attachment structure 44. It will be clear that the attachment structures shown are by way of illustration only and that many alternative configurations are within the scope of the present invention.

As shown in FIG. 4, forward attachment structure 42 comprises first attachment component 92 and second attachment component 94. Component 92 includes first web member 96 which extends outwardly from the forward end of shroud backing 38 and first rail section 98 which extends from first web member 96. Component 94 includes second rail section 100 and second web member 102. As described more fully hereinafter, component 94 is folded back on component 92 forming a first circumferentially extending 180° bend 46g so that first web member 96 and first rail section 98 substantially conform to second web member 102 and second rail section 100, respectively. Web members 96 and 102 thereby form a web, and rail sections 98 and 100 form a forward rail 30.

Similarly, aft attachment structure 44 comprises third attachment component 104 and fourth attachment component 106. Component 104 includes third web member 108 which extends outwardly from the aft end of shroud backing 38, and third rail section 110 which extends from web member 108. Component 106 includes fourth rail section 112 and fourth web member 114. Attachment, structure 44 is formed by folding component 106 back on component 104 forming a second circumferentially extending 180° bend 46b so that third web member 108 and third rail section 110 substantially conform to fourth web member 114 and fourth rail section 112, respectively. Web members 108 and 114 thereby form a web, and rail sections 110 and 112 form an aft rail 32.

As shown in FIG. 2, each panel 24 is attached to support 28 by the capture of forward rail 30 and aft rail 32 of panel 24 by forward slot 34 and aft slot 36 of support 28, respectively. In addition to the generally arcuate shape of panel 24 in circumferential direction 40, bends **46*a*, 46*b*, 46*c*, 46*d*, 46*e*, 46*f*, 46*g*, and 46*h* are formed substantially normal to direction 40**. In the neighborhood of each bend, a bent region is formed defining compression stresses result from both the arcuate shape and the normal bend thereto.

Figure 5:
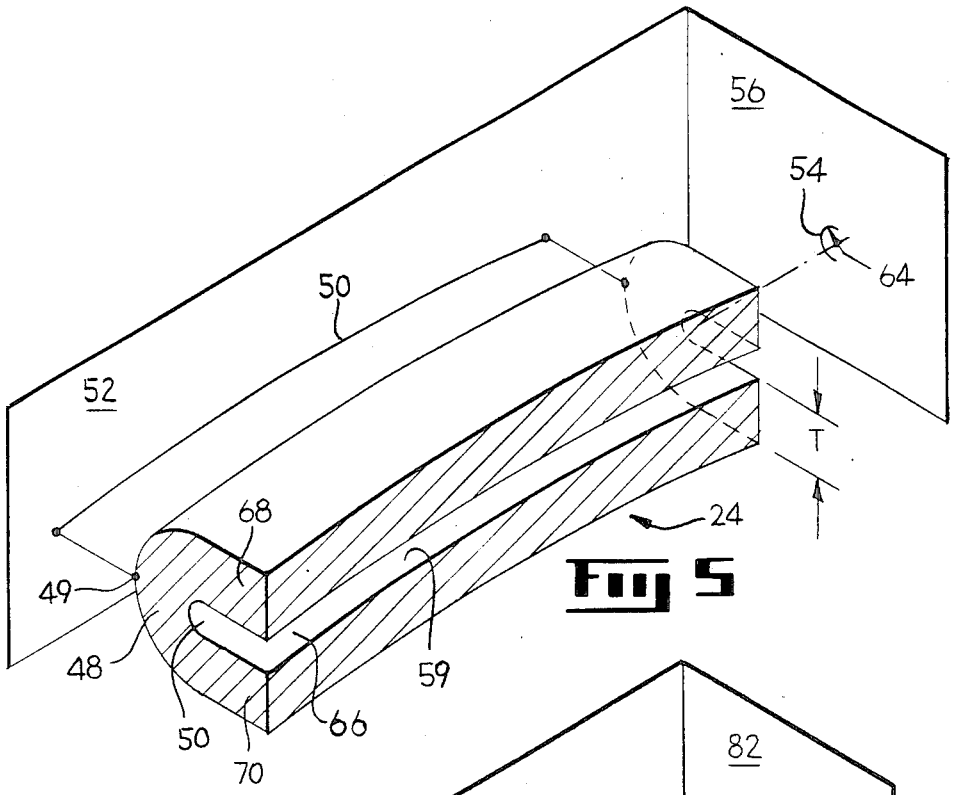
FIG. 5 is a perspective view of a bent region of a sheet metal panel.

FIG. 5 shows more detail of bent region 48 of panel 24 in the neighborhood 180° of bend **46*g*. Bent region 48 defines a first arc 50 of intersection with first plane 52. Plane 52 is generally parallel to a plane tangent to the apex 49 of bend 46*g*. The radius of arc 50 is the distance to the center line of the engine. Bent region 48 further defines a second arc 54 with second plane 56. Plane 56 is taken as normal to first plane 52 in a preferred embodiment. Arc 54 is the image of inner surface 59 of bent region 48 and corresponds to the inner radius 180° of bend 46*g*. In general, the radius 64 of arc 54 will be less than twice the thickness (2T) of panel 24. In the case of 180° bend 46*g*, wherein panel 24 is folded back on itself, radius 64 of arc 54 is much less than the thickness (1T) of panel 24 and approaches zero. The measure of arc 54 will be approximately 180° since panel 24 folds back on itself at bend 46*g***.

Various reasons may exist for maintaining a small radius bend on bend **46*g*. As shown in FIG. 2, forward rail 30 must be received by forward slot 34. Close dimensional control must be maintained at this interface. Consequently, a large radius bend creating a bulbous end on rail 30 would adversely affect this mating. In addition, the gap 66 between rail sections 68 and 70 will be brazed. In order to achieve good strength, gap 66** must be narrow throughout its length.

Typically in the past, the inner radius of bends in the sheet metal materials listed above must be greater than or equal to twice the thickness (2T) of panel 24 to avoid fracturing. In the present invention, tighter bends of less than 2T and approaching zero have been achieved. The sheet metal panel is first stressed by forming it to its circumferential arcuate shape. This establishes tensile and compressive stresses in the panel in the circumferential direction. This arc is held while the piece is bent to a very small radius arc in a second direction. A biaxial stress condition is created by this process thereby allowing these small radii bends to be achieved.

Figure 6:
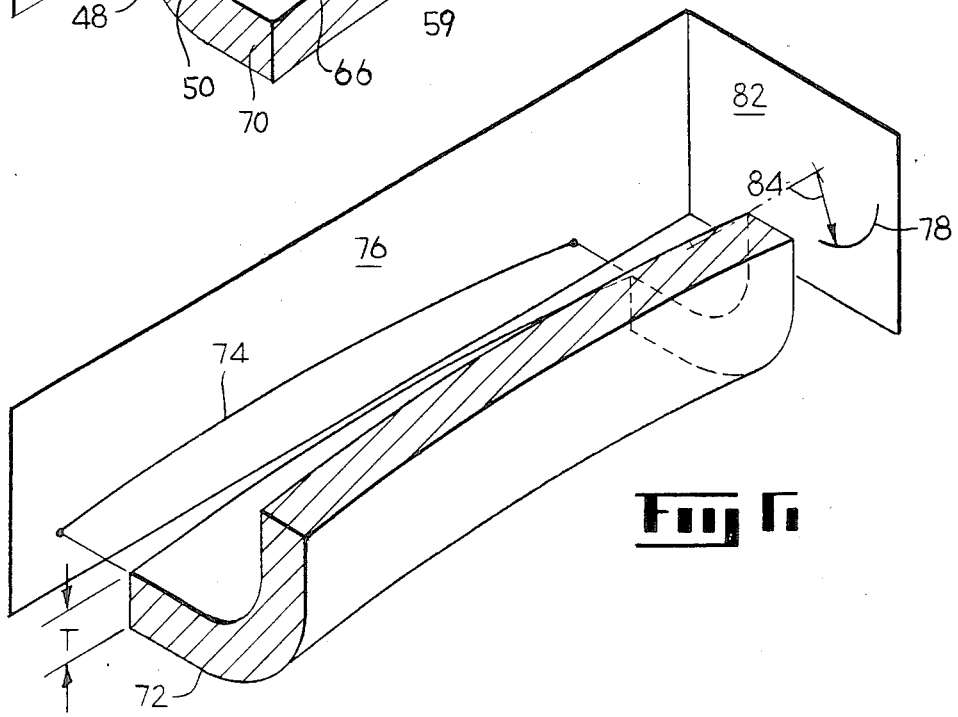
FIG. 6 is a perspective view of another bent region of a sheet metal panel.

Although folding a panel back on itself, such as shown in FIGS. 2–5 may be necessary to form rails 30 and 32, other tight radius bends may be required elsewhere in the panel. For example, a bent region 72 in the neighborhood of bend **46*d* is shown in FIG. 6. Region 72 defines a first arc 74 of intersection with a first plane 76. Region 72 defines a second arc 78 of intersection with a second plane 82. Arc 78, which corresponds to bend 46*d*, has a radius 84 of less than twice the thickness (2T) of panel 24. In a preferred embodiment, radius 84** is approximately 1T, although smaller radii are attainable if required.

Tight bends may be achieved wherever necessary to duplicate the contours of prior art cast panels. For example, bends **46*a* and 46*c* may be tight to increase the amount of surface area of aft rail 32 which contacts aft slot 36. Bend 46*d* may be tight to increase the area bonding contact between web members 108 and 114 of web 90. As with bend 46*g*, shown in FIG. 4**, the radii of tight bends may approach zero where required.

It may be desirable to braze joints 60 and 61 shown in FIG. 4, where attachment components 92 and 94, and 104 and 106 conform, respectively. One method by which these joints may be brazed is vacuum bonding. More particularly, the process as described in Keller et al, U.S. Pat. No. 4,098,450, may be advantageously employed.

It will be clear to those skilled in the art that the present invention is not limited to the specific embodiments described and illustrated herein. Nor is the invention limited to turbine shrouds in gas turbine engines. Rather, the invention applies equally to any arcuate sheet metal panel with a tight radius bend in a gas turbine engine.

It will be understood that the dimensions and proportional and structural relationships shown in the drawings are illustrated by way of example only and those illustrations are not to be taken as the actual dimensions or proportional structural relationships used in the panel of the present invention.

Numerous modifications, variations, and full and partial equivalents can be undertaken without departing from the invention as limited only by the spirit and scope of the appended claims.

What is desired to be secured by Letters Patent of the United States is the following.

What is claimed is:

1. A gas turbine engine with an annular flowpath, said engine having:

a compressor, combustor, and turbine in serial flow communication within said flowpath; and a sheet metal panel attached to a support and defining at least one portion of said flowpath in said turbine, wherein said sheet metal panel comprises:

a bent region for attaching said sheet metal panel to said support wherein said support includes a slot and said bent region is inserted in said slot;

said region defining a first arc of intersection with a first plane and defining a second arc of intersection with a second plane, wherein said second arc has a radius of less than twice the thickness of said sheet metal panel.

2. A gas turbine engine, as recited in claim 1, wherein the thickness of said sheet metal panel is greater than 25 mils.

3. A gas turbine engine, as recited in claim 1, wherein said second plane is normal to said first plane.

4. A gas turbine engine, as recited in claim 3, wherein said second arc has a measure of approximately 180°.

5. A gas turbine engine, as recited in calim 4, wherein said second arc has a radius of less than the thickness of said sheet metal panel.

6. A gas turbine engine with an annular flowpath, said engine having:

a compressor, combustor, and turbine in serial flow communication with said flowpath; and a sheet metal panel defining at least one portion of said flowpath in said turbine, wherein said sheet metal panel comprises:

a generally arcuate backing with forward and aft ends;

a first web extending outwardly from said backing; and a first rail extending from said first web, said rail including first and second rail sections wherein said second section is folded back on said first section thereby forming a bent region;

said bent region defining a first arc of intersection with a first plane and defining a second arc of intersection with a second plane, said second arc having an inner radius of less than the thickness of said sheet metal panel.

7. A gas turbine engine, as recited in claim 6, wherein said first web forms a first bend with respect to said backing, said first bend having an inner radius of less than twice the thickness of said sheet metal panel.

8. A gas turbine engine, as recited in claim 6, wherein said first rail forms a second bend with respect to said first web, said second bend having an inner radius of less than twice the thickness of said sheet metal panel.

9. A gas turbine engine, as recited in claim 6, wherein said first rail extends substantially parallel to said backing.

10. A gas turbine engine, as recited in claim 6, wherein said first web extends from said forward end of said backing, said sheet metal panel further comprising:

a second web extending outwardly from aid aft end of said backing; and a second rail extending from said second web, said second rail including third and fourth sections wherein said fourth section is folded back on said third section thereby forming a second bent region;

said second region defining a third arc of intersection with a third plane and defining a fourth arc of intersection with a fourth plane, said fourth arc having an inner radius of less than the thickness of said sheet metal panel.

11. A gas turbine engine with an annular flowpath, said engine having:

a compressor, combustor, and turbine in serial flow communication within said flowpath; and a sheet metal panel, formed from a single piece of sheet metal, defining at least one portion of said flowpath in said turbine; wherein said sheet metal panel comprises:

a generally arcuate backing with forward and aft ends;

a first attachment component including a first web member extending outwardly from said backing and a first rail section extending from said first web member; and a second attachment component including a second rail section and a second web member, said second attachment component being folded back on said first attachment component so that said second rail section substantially conforms to said first rail section and said second web member substantially conforms to said first web member thereby forming a first bent region;

said first bent region defining a first arc of intersection with a first plane and defining a second arc of intersection with a second plane, said second arc having an inner radius of less than the thickness of said sheet metal panel.

12. A sheet metal panel, as recited in claim 11, wherein said first web member forms a first bend with respect to said backing, said first bend having an inner radius of less than twice the thickness of said sheet metal panel.

13. A sheet metal panel, as recited in claim 11, wherein said first and second rail sections form a second bend with respect to said first and second web members, said second bend having an inner radius of less than twice the thickness of said sheet metal panel.

14. A sheet metal panel, as recited in claim 11, wherein said first rail section extends substantially parallel to said backing.

15. A sheet metal panel, as recited in claim 11, wherein said first attachment component extends from said forward end of said backing, said segment further comprising:

third attachment component including a third web member extending outwardly from said aft end of said backing and a third rail section extending from said third web member; and a fourth attachment component including a fourth rail section and a fourth web member, said fourth attachment component being folded back on said third attachment component so that said fourth rail section and fourth web member substantially conform to said third rail section and third web member, respectively, thereby forming a second bent region;

said second bent region defining a third arc of intersection with a third plane and defining a fourth arc of intersection with a fourth plane, said fourth arc having an inner radius of less than the thickness of said sheet metal panel.

16. A sheet metal panel, as recited in claim 11, wherein said thickness is greater than 25 mils.

17. In a gas turbine engine with an annular flowpath for gases flowing therethrough, a sheet metal panel attached to a support and defining at least one portion of said flowpath in said turbine, wherein said sheet metal panel comprises:

a rail formed from an end of said sheet metal panel folded over on itself and contacting forming a bent region for attaching said sheet metal panel to said support;

said region defining a first arc of intersection with a first plane and defining a second arc of intersection with a second plane, wherein said second arc has a radius of less than twice the thickness of said sheet metal panel.

18. A sheet metal panel defining a portion of the turbine flowpath in a gas turbine engine, said sheet metal panel comprising: a rail formed from an end of said sheet metal panel folded over on and contacting itself forming a bent region; said bent region defining a first arc of intersection with a first plane and defining a second arc of intersection with a second plane, wherein said second arc has a radius of less than twice the thickness of said sheet meal panel.

19. A sheet metal panel, as recited in claim 18, wherein the thickness of said sheet metal panel is greater than 25 mils.

20. A sheet metal panel, as recited in claim 18, wherein said second plane is normal to said first plane.

21. A sheet metal panel, as recited in claim 20, wherein said second arc has a measure of approximately 180°.

22. A turbine shroud defining a portion of the turbine flowpath in a gas turbine engine, comprising:

a generally arcuate sheet metal shroud backing with forward and aft ends;

a first web extending outwardly from said backing; and a first rail extending from said first web, said rail including first and second rail sections wherein said second section is folded back on said first section thereby forming a bent region;

said bent region defining a first arc of intersection with a first plane and defining a second arc of intersection with a second plane, said second arc having an inner radius of less than the thickness of said sheet metal shroud backing.

23. A turbine shroud, as recited in claim 22, wherein said first web forms a first bend with respect to said backing, said first bent having an inner radius of less than twice the thickness of said sheet metal shroud backing.

24. A turbine shroud, as recited in claim 22, wherein said first rail forms a second bend with respect to said first web, said second bend having an inner radius of less than twice the thickness of said sheet metal shroud backing.

25. A turbine shroud, as recited in claim 22, wherein said first rail extends substantially parallel to said shroud backing.

26. A turbine shroud, as recited in claim 22, wherein said first web extends from said forward end of said sheet metal shroud backing, said sheet metal shroud backing further comprising:

a second web extending outwardly from said aft end of said backing; and a second rail extending from sid second web, said second rail including third and fourth sections wherein said fourth section is folded back on said third section thereby forming a second bent region;

said second bent region defining a third arc of intersection with a third plane and defining a fourth arc of intersection with a fourth plane, said fourth arc having an inner radius of less than the thickness of said sheet metal shroud backing.

27. A turbine shroud, as recited in claim 26, wherein said sheet metal shroud backing is formed from a single piece of sheet metal.

28. A sheet metal panel defining a portion of the turbine flowpath in a gas turbine engine, said sheet metal panel comprising:

a bent region; said bent region defining a first arc of intersection with a first plane and defining a second arc of intersection with a second plane wherein;

said second plane is normal to said first plane, and said second arc has a radius less than the thickness of said sheet metal panel, and the thickness of said sheet metal panel is greater than 25 mils, and said second arc has a measure of approximately 180°, and said bent region is a means for attaching said sheet metal panel to a support.

* * * * *